United States Patent [19]

Gaugel et al.

[11] Patent Number: 4,794,297

[45] Date of Patent: Dec. 27, 1988

[54] SHIELDED DISCHARGE-TYPE AUTOMOTIVE HEAD LAMP

[75] Inventors: Manfred Gaugel, Fürstenfeldbruck; Jügen vom Scheidt, Taufkirchen; Ewald Wurster, Grünwald, all of Fed. Rep. of Germany

[73] Assignee: Patent-Treuhand-Gesellschaft für elektrische Glühlampen mbH, Munich, Fed. Rep. of Germany

[21] Appl. No.: 947,616

[22] Filed: Dec. 30, 1986

[30] Foreign Application Priority Data

Jan. 20, 1986 [DE] Fed. Rep. of Germany ... 8601283[U]

[51] Int. Cl.[4] ..... H01J 5/16

[52] U.S. Cl. ..... 313/117; 313/489

[58] Field of Search ..... 313/25, 117, 571, 578, 313/586, 634, 635

[56] References Cited

U.S. PATENT DOCUMENTS

| | | | |
|---|---|---|---|
| 3,234,421 | 2/1966 | Reiling | 313/25 |
| 3,784,861 | 1/1974 | Notelters et al. | 313/117 |
| 4,305,015 | 12/1981 | Honda et al. | 313/117 X |
| 4,305,016 | 12/1981 | Schmidt | 313/117 |
| 4,479,071 | 10/1984 | T'Jampens et al. | 313/25 |
| 4,594,529 | 6/1986 | de Vrijer | 313/571 |
| 4,658,177 | 4/1987 | Gosslar et al. | 313/25 |

FOREIGN PATENT DOCUMENTS

| | | | |
|---|---|---|---|
| 3232207 | 3/1984 | Fed. Rep. of Germany . | |
| 1123574 | 8/1968 | United Kingdom | 313/117 |

*Primary Examiner*—David K. Moore

*Attorney, Agent, or Firm*—Frishauf, Holtz, Goodman & Woodward

[57] ABSTRACT

To provide light distribution required by legal and safety requirements for automotive head lamps from a discharge lamp, a discharge vessel or bulb (2, 12) is retained within an outer bulb (7, 17), which outer bulb is made of hard glass and is coated at the outside with a visible light radiation absorbing coating (8, 18) directly applied to the outer bulb, and placed thereon to provide the desired light distribution. Thus, standard silicon iron oxide black can be used for the coating. Preferably, the inside of the outer bulb has a coating of infrared absorbing, visible light transmitting material applied thereto.

11 Claims, 2 Drawing Sheets

SHIELDED DISCHARGE-TYPE AUTOMOTIVE HEAD LAMP

The present invention relates to head lamps for automotive use, and more particularly to head lamps in which the light source is a discharge lamp, and the light emanation from the light source is shielded so that the light distribution demanded by legal and safety requirements can be met.

BACKGROUND

It is known to secure a shielding cap within the lamp housing of automotive-type incandescent lamps. The shielding cap partially surrounds the incandescent filament. When using a light source which is not an incandescent filament, however, for example a discharge lamp, this solution is not practical since the high temperatures of the discharge arc result in at least deformation, and, possibly destruction of the shielding cap.

It has been proposed to apply a radiation absorbing coating at the outside of a discharge vessel which should have the same effect as a shielding cap located within the bulb of an incandescent lamp. It has been found that assembly of vehicular or automotive-type discharge lamps having an outer shielding coating results in heat distribution which is unsatisfactory and which interferes with long lifetime of the shielding coating.

THE INVENTION

It is an object to improve an automotivetype discharge lamp in which shielding elements will be stable in operation.

Briefly, an outer bulb is provided to surround the discharge vessel of the discharge lamp, the outer bulb retaining the discharge vessel or discharge bulb therein. The lamp base is secured to the outer bulb or outer vessel. The shielding element, which forms a partial shielding structure to control light distribution, is a light radiation absorbing coating which is directly applied to the outer bulb.

The combination of inner and outer bulb, with the shielding applied to the outer bulb, has the advantage that the outer bulb, coupled to the base of the lamp and typically made of hard glass, controls the heat balance of the discharge vessel or bulb and, then, of the lamp as a whole. This improves the color temperature and further accelerates starting of the discharge lamp when energized. The radiation absorbing coating, applied to the outer bulb, then can be made of a material which is well known for automotive-type incandescent lamps, namely silicon iron oxide, which has only low heat loading capability, that is, persistence under high temperature. The outer bulb, being at a substantially lower temperature than the discharge vessel or discharge bulb, will be at a temperature which is readily acceptable to coating by silicon iron oxide. That portion of the outer bulb which does not have the light radiation coating can then be coated by a material which reflects infrard (IR) radiation while, however, permitting ready passage of visible light. This additional coating improves the color temperature of the light being emitted, as well as the starting speed of the discharge lamp while, also, reducing the proportion of ultraviolet (UV) radiation.

DRAWINGS

DETAILED DESCRIPTION

Figure 1:
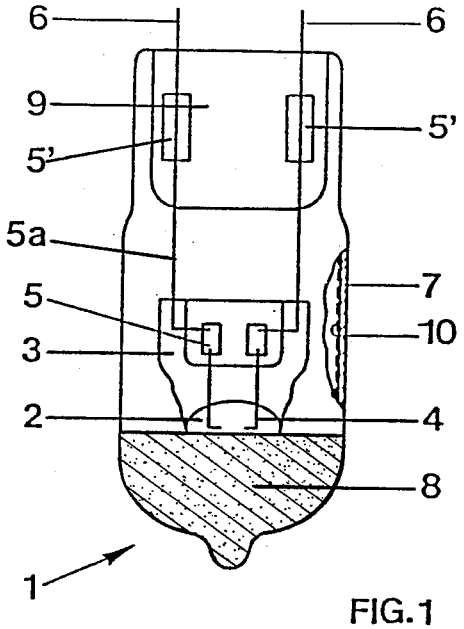
FIG. 1 is a front view, partly broken away, of a single-ended discharge lamp incorporating the present invention.
Figure 2:
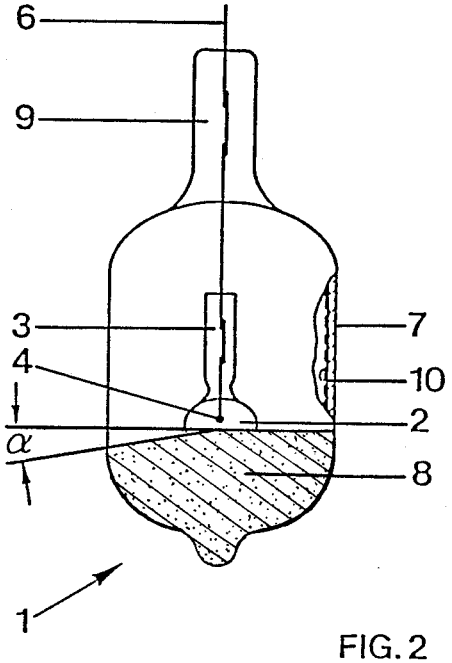
FIG. 2 is a side view of the lamp of FIG. 1, rotated, with respect to FIG. 1, by 90°.

Referring first to FIGS. 1 and 2: The lamp 1 has a discharge vessel or discharge bulb 2 made of quartz glass. The bulb 2 terminates in a press or pinch seal 3. Two electrodes 4 are located within the discharge vessel; electrical connection from the electrode 4 to the outside of the lamp is made via molybdenum foils 5 enclosed and sealed in the pinch or press seal 3, connecting conductors **5*a* connected, for example by welding, to the molybdenum foils 5, and a second group of molybdenum foils 5' which are pinch-sealed in a pinch seal 9 of an outer bulb, as will appear. The molybdenum foils 5', in turn, are connected to external connection leads 6**.

The discharge vessel 2 retains a fill of 2.3 mg mercury, as well as halides of sodium, thallium and tin, overall of about 0.3 mg or, if desired, of sodium and scandium of about 0.9 mg.

In accordance with a feature of the invention, an outer bulb 7 of hard glass is fitted over the discharge vessel 2 and the dome of the outer bulb 7 is coated with a visible radiation absorbing coating 8. The coating 8 is applied to the outer bulb 7 to reach approximately level with and up to the ends of the electrodes 4, as seen in FIG. 1. Looked at rotated 90°—see FIG. 2—it can be seen that the coating 8 extends approximately level or circumferentially to about half the center line of the lamp on a first (right) side and then is angled off on a second (left) side by an angle $\alpha$ of about 15° to provide for a nonsymmetrical light distribution, as required by "low-beam" light distribution from a vehicular-type, typically automotive-type head lamp. The arrangement permits use of radiation absorbing coating of silicon iron oxide, which is applied by dipping. The outer bulb 7 is extended to beyond the pinch seal 3 of the bulb, and is, in turn, closed off by a pinch seal 9, forming a lamp base portion, retaining the molybdenum foils 5' and carrying the outer conductor terminal leads 6.

In accordance with a feataure of the invention, the inside of the outer bulb 7 is coated with a coating 10 which reflects IR radiation, while permitting passage of visible light. The space between the walls of the discharge vessel 2 and the outer bulb 7 is evacuated, which improves the operating conditions of the lamp. A lamp of this type has a power rating of about 35 W with an arc voltage of about 110 V.

Figure 3:
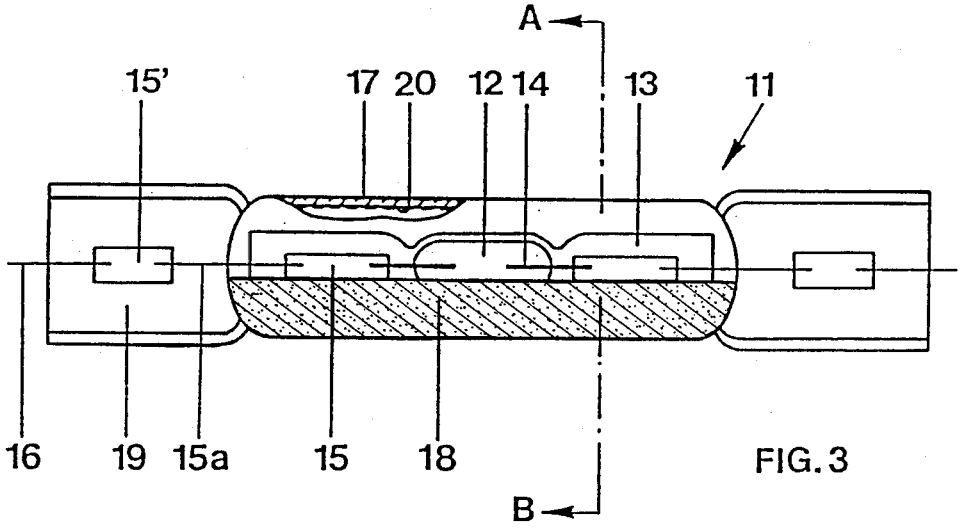
FIG. 3 is a side view, partly broken away, of a double-ended discharge lalmp incorporating the present invention.
Figure 4:
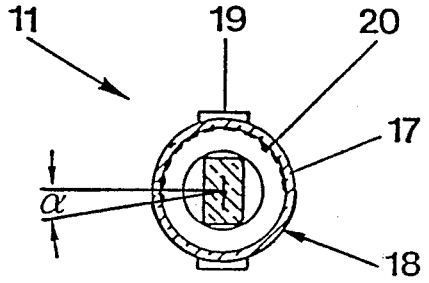
FIG. 4 is a cross section along the lines A-B of FIG. 3.

Embodiment of FIGS. 3 and 4:

Lamp 11 is a double-ended vehicular-type discharge lamp, in which the inner or discharge vessel 12 is in oval shape, terminating at both right and left sides—with respect to FIG. 3—in pinch seals 13. The electrodes 14 are connected to the outer terminal leads 16 over sealing foils 15, connecting leads **15*a*, and outer sealing foils 15'. The discharge vessel 12 is surrounded by an outer bulb 17 of elongated form and made of hard glass. The outer surface is coated with a coating 18 of silicon iron oxide, at about half the circumference thereof, and over the entire length of the bulb, that is, excluding the terminal pinch seals 19, which form the base portions or terminations of the lamp. The uncoated portion of the outer bulb 17 is coated internally with a coating 20 transmitting visible radiation, but reflecting IR radiation. The light absorbing coating 18, as in the embodiment of FIGS. 1 and 2**, does not extend level or circumferentially all around the bulb but, rather, on one second, side of the bulb the coating is depressed by an angle $\alpha$ of again about 15°. The coating, as shown, including the depressed portion defined by the angle $\alpha$, is applied as before, for example by dipping the lamp in a suitable coating bath. The lamp is mirror-symmetrical with respect to a transverse axis.

Various changes and modifications may be made; for example, a double-ended inner discharge bulb 12 can be enclosed in a single-ended outer bulb, as shown in FIGS. 1 and 2, with the only modification necessary being to take the connecting lead 15*a* in the space between the discharge bulb and the outer bulb to the single-ended pinch or press seal 9 (FIGS. 1, 2).

The coating 8, 18 is applied by dipping the finished lamp into a coating trough, so that the coating will be applied to the outer bulb at the outside thereof.

We claim:

1. Shielded discharge-type vehicular head lamp (1,11) having a discharge vessel or discharge bulb (2,12):

electrode leads (5*a*, 15*a*) extending from said discharge vessel or discharge bulb;

a base (9,19):

terminal leads (6,16) extending from said base;

and means for partially shielding visible light radiation emitted from the discharge vessel or discharge bulb and for asymmetrically direction light in accordance with the desired light distribution pattern, comprising, in accordance with the invention, an outer bulb (7,17) of transparent material surrounding said discharge vessel or discharge bulb (2,12) and retaining said discharge vessel or discharge bulb therein;

wherein the base (9,19) and the outer bulb form a unitary element, the discharge vessel (2, 12) is sealed within the outer bulb (7,17) and spaced from the inner wall of the outer bulb, and the space between the discharge vessel and the outer bulb is evacuated; and wherein the partial shielding and asymmetrically light-directing means comprises a visible-light radiation-absorbing coating (8,18) directly applied to the outer bulb and extending further along a first side of said outer bulb than along a second, opposing, side of said outer bulb.

2. The lamp of claim 1, wherein the outer bulb (7, 17) comprises hard glass.

3. The lamp of claim 1, wherein the radiation absorbing coating (8, 18) comprises silicon iron oxide.

4. The lamp of claim 1, wherein the lamp is a singleended discharge lamp, and the terminal leads (5*a*) from the discharge vessel or discharge bulb (2) extend from a single pinch or press seal formed on the discharge vessel or bulb.

5. The lamp of claim 1, wherein the discharge lamp is a double-ended discharge lamp, and the discharge vessel (12) is formed with two pinch or press seals (13), one terminal lead (15*a*), each, extending from one of the pinch or press seals of the discharge vessel or discharge bulb.

6. The lamp of claim 1, including an infrared radiation reflecting, visible light-transmitting coating (10, 20) located at the inside wall of the outer bulb (7, 17).

7. the lamp of claim 6, wherein infrared radiation reflecting, visible light-transmitting coating (10, 20) is placed on the portion of the outer wall which is not coated by said radiation-absorbing coating (8, 18).

8. The lamp of claim 1, wherein the outer bulb (7, 17) is terminated in at least one pinch or press seal (9, 19).

9. The lamp of claim 8, wherein the outer bulb (7, 17) comprises hard glass.

10. The lamp of claim 9, wherein the radiation absorbing coating (8, 18) comprises silicon iron oxide.

11. The lamp of claim 2, wherein the radiation absorbing coating (8, 18) comprises silicon iron oxide.

* * * * *

UNITED STATES PATENT AND TRADEMARK OFFICE

CERTIFICATE OF CORRECTION

PATENT NO. : 4,794,297

DATED : December 27, 1988

INVENTOR(S) : GAUGEL et al

It is certified that error appears in the above-identified patent and that said Letters Patent is hereby corrected as shown below:

In the title page, the correct name of the second inventor should be: --Jürgen vom Scheidt--.

Column 3, line 40, "direction" should read --directing--.

Column 4, line 14, add the following text after the word "bulb":

--said coating having, on said first side, an edge which is approximately circumferentially disposed on said lamp and, on said second side, an edge which is depressed by an angle of about 15° with respect to a plane defined by said approximately circumferential edge--.

Column 4, lines 19-20, "sin-gleended" should read --single-ended--.

Signed and Sealed this

Sixth Day of February, 1990

*Attest:*

JEFFREY M. SAMUELS

*Attesting Officer*

*Acting Commissioner of Patents and Trademarks*